United States Patent [19]

Renda

[11] 4,191,200

[45] Mar. 4, 1980

[54] HAIR DRESSING COMB

[76] Inventor: Frank J. Renda, 752 Colonial Ave., York, Pa. 17403

[21] Appl. No.: 884,920

[22] Filed: Mar. 9, 1978

[51] Int. Cl.[2] ..... A45D 24/10

[52] U.S. Cl. ..... 132/123

[58] Field of Search ..... 132/123, 11 R, 126, 132/129, 139, 143, 121, 31 R, 33 R, 34 R, 133, 150; 15/165, 184

[56] References Cited

U.S. PATENT DOCUMENTS

| | | | |
|---|---|---|---|
| 2,137,828 | 11/1938 | Arpin et al. | 132/123 |
| 2,244,068 | 6/1941 | Kay | 132/123 |
| 2,245,056 | 6/1941 | Schlicker | 132/123 |
| 2,803,256 | 8/1957 | Lerner | 132/123 UX |
| 3,386,185 | 6/1968 | Angelillo | 132/9 |

*Primary Examiner*—G. E. McNeill
*Attorney, Agent, or Firm*—C. Hercus Just

[57] ABSTRACT

A hair dressing comb having a tubular housing within which a plurality of elongated combs are mounted in circumferentially spaced relationship for radial movement between retracted positions within said housing and projected operative positions. A handle extends from one end of said housing and supports a manually operable knob which operates a pair of cams within the housing which engage spaced portions on said combs to project the same when said knob is moved in one direction, and spring members engaging said combs are flexed in a direction to retract said combs when said knob is moved in the opposite direction.

8 Claims, 7 Drawing Figures

HAIR DRESSING COMB

BACKGROUND OF THE INVENTION

Beauticians and barbers who engage in various hair treating operations, especially curling operations, employ combs to accomplish the same. When employing a conventional comb for curling operations, it is not possible to remove the comb from a curl after the completion thereof without largely destroying the curl either by uncurling the same or otherwise. Accordingly, a number of inventions have been made previously in the comb art by which the teeth of combs may be retracted at the completion of a curing operation, for example, and thereby permit the comb to be withdrawn from the formed curl. Some of the more simple types of combs for this purpose which employ only a single comb retractable into the body thereof are illustrated in U.S. Pat. Nos. 2,245,056 to Schlicker, dated June 10, 1941, 2,584,023 to Johnson et al, dated Jan. 29, 1952, and 2,672,876, to Bedwell, dated Mar. 23, 1954. The foregoing types of combs were manually operable to effect the retraction of the combs into slots formed in the bodies thereof. An additional embodiment of this type of comb is illustrated in U.S. Pat. No. 3,260,269 to Zurndorfer, dated July 12, 1966, in which rotatable spur gears engage short racks formed on a single comb member in a manner by which rotation of the handle effected withdrawal of the comb teeth into the body thereof and reverse movement of the handle effected projection of the teeth therefrom.

Another even earlier type of comb operated by cam means is illustrated in U.S. Pat. No. 1,280,180 to Deason, dated Oct. 1, 1918, and in which a single comb member in the midst of brush bristles is adapted to be retracted and projected by means of cam slots in the comb, the comb being retracted and projected by means of a manually movable button, slidable along the handle of the comb and brush.

Certain inventors also subsequently developed combs of the foregoing type in which two or more combs mounted on a single body were rendered retractable and projectable by various means, typical examples of which are shown in U.S. Pat. Nos. 2,244,068 to Kay, dated June 3, 1941; 3,148,685 to Haynes et al, dated Sept. 15, 1964; and 3,381,693 to Stevens, dated May 7, 1968. In the Kay patent, one embodiment is illustrated in which four combs are adapted to be projected or retracted by means of rotation of a mounting member within a cylindrical housing to effect a somewhat compound movement of the combs which ultimately effects a radial position of the same with respect to the body, while in another embodiment, rows of either brushes or combs are projected and retracted by means of linkages actuated by threaded means which are rotated by longitudinal movement of a manually operable button slidable along a handle at one end of the comb device.

The present invention has been devised in an effort to provide mechanical means by which, preferably, a greater number of combs than four may be commonly actuated to either retract or project the same with respect to a substantially cylindrical body, and this is accomplished by means not shown in the foregoing patents.

SUMMARY OF THE INVENTION

It is the principal object of the present invention to provide a substantially cylindrical body which is hollow and conveniently may be formed from tubing, said body enclosing a plurality of similar elongated rigid comb members having teeth which are projectable through openings in said housing, said combs being projectable by cam means, movable axially within said housing, said cam means being spaced axially so as to engage said comb members adjacent opposite ends thereof to effect such projection, opposite ends of the housing having radial slots therein which slidably receive opposite ends of the comb members to guide the same for radial movement, and spring means are provided to retract said comb members when the cam means are moved oppositely to the directions in which they are moved to project the combs radially.

It is another object of the invention to utilize substantially conical cams in the aforementioned comb structure which is spaced longitudinally along an elongated axially extending member which projects into the handle and has an operating button slidable on the handle and connected to said elongated member, said cams engaging certain surfaces in notches formed in the comb member when the cams are moved in one direction in order to project the combs from their enclosing housing.

It is a further object of the invention to utilize slightly arched wire spring members to retract the combs of the aforementioned comb structure, said spring members being connected to mid-points of said combs and the opposite ends of said spring members engaging the inner surface of the housing, whereby the flexed nature of the springs effects the retraction of the combs when the cams have been moved in the direction to permit such retraction.

Still another object of the invention is to provide elongated passage means in the handle of the comb structure which communicate with the hollow interior of the housing, whereby a blower may be attached to the outer end of the handle and thereby blow drying air through the handle into the interior of the housing for escape through clearances in the housing wall around each of the teeth of the combs for purposes of drying hair incident to curling operations or otherwise.

Details of the foregoing objects and of the invention, as well as other objects thereof, are set forth in the following specification and illustrated in the accompanying drawings comprising a part thereof.

DETAILED DESCRIPTION

Figure 1:
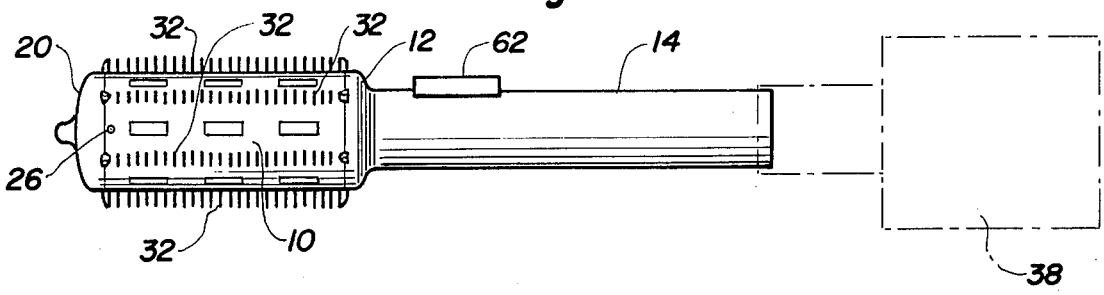
FIG. 1 is an elevation of a hair-curling comb embodying the principles of the present invention and also showing, in phantom, an exemplary air-blowing unit, adapted to be connected to the outer end of the handle.

Referring to the drawings, the hair dressing comb comprising the present invention includes a housing 10 which preferably is cylindrical and may be formed from any suitable material, such as plastics, or metal, for example, one end 12 of said housing extending transversely across the axis of the housing and having a suitable handle 14 formed thereon. In the illustrations shown in FIGS. 1–3, the handle is illustrated as being substantially cylindrical but any other appropriate, convenient and comfortable shape may be utilized in accordance with the principles of the invention. It is preferred, however, that the handle have an elongated passage 16 extending therethrough for communication with the interior of the preferably hollow housing 10 by means, for example, of apertures 18 which are clearly shown in FIG. 4.

The forward end of the housing 10 is closed by an outer end member 20. The inner face of the outer member 20 is provided with a plurality of radial guide slots 22 and correspondingly, the inner surface of said one end 12 is provided with similar radially extending guide slots 24. The outer end member 20 has a short portion projecting telescopically within the circular interior of housing 10 and within which the radial guide slots 22 are formed. Referring to FIG. 1, it will be seen that one of a plurality of screws 26 is shown, which extends through the wall of the cylindrical housing 10 and is threaded into the aforementioned projection on end member 20 for purposes of securing the same to the housing 10.

Figure 3:
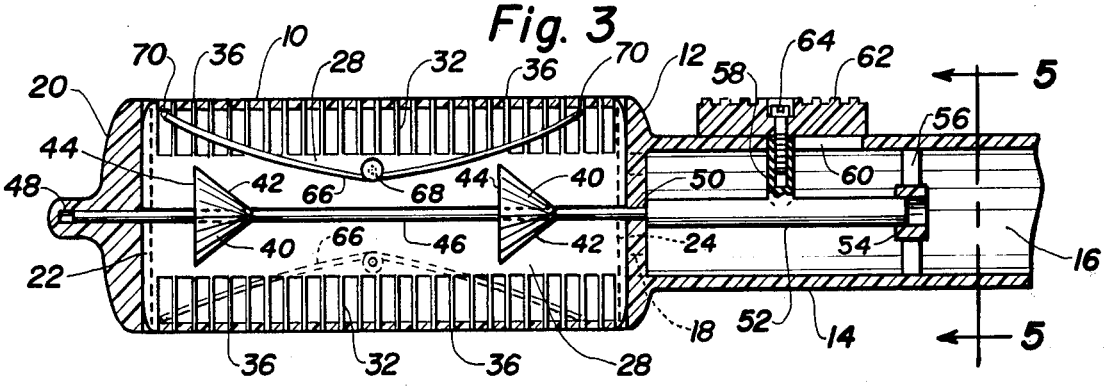
FIG. 3 is a view similar to FIG. 2, but illustrating the combs in retracted position.
Figure 4:
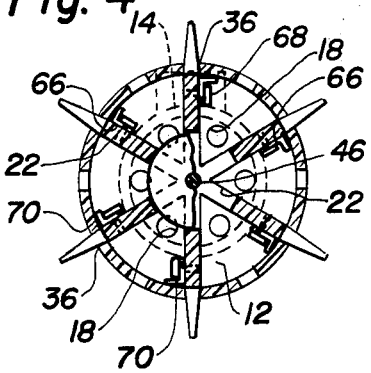
FIG. 4 is a transverse sectional view as seen on the line 4—4 of FIG. 2.
Figure 6:
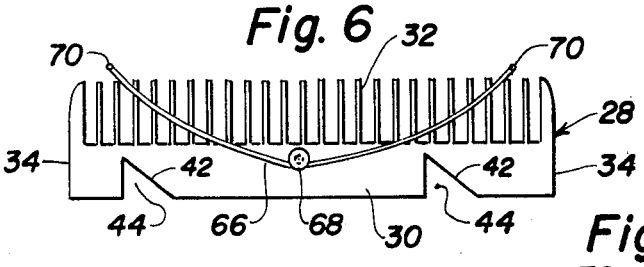
FIG. 6 is a plan view of one of the comb members per se, such as shown in assembled relationship with other combs seen in FIGS. 2–4.
Figure 5:
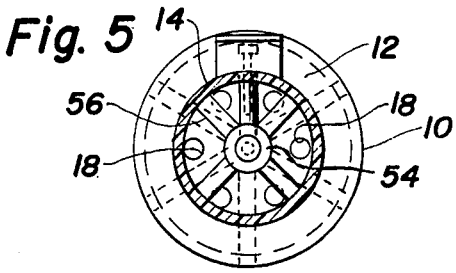
FIG. 5 is a transverse sectional view as seen on the line 5—5 of FIG. 3.

As will be seen particularly from FIGS. 4 and 5, the hair dressing comb comprising the present invention preferably includes at least six combs 28, details of which are best shown in FIG. 6. Said combs may be formed from any suitable material, such as plastics or metal, and the same comprise an elongated flat bar 30 from which a plurality of teeth 32 project. The opposite ends 34 of the combs respectively are received in axially aligned radial slots 22 and 24, which are within the opposite ends of the housing and are thereby guided for radial movement between the projecting positions shown in FIG. 2 and the retracted positions shown in FIG. 3. The teeth 32 extend through suitable openings 36 formed in the walls of the housing 10 and said openings preferably are slightly larger in diameter than the teeth 32 for purposes of providing clearance around the teeth in order that air may be discharged therethrough when a blower 38, for example, is mounted on one end of the handle 14, as shown in phantom in FIG. 1, and thereby blow drying air through the handle, the openings 18, and the interior of the housing 10, which communicate with the openings 36.

Figure 2:
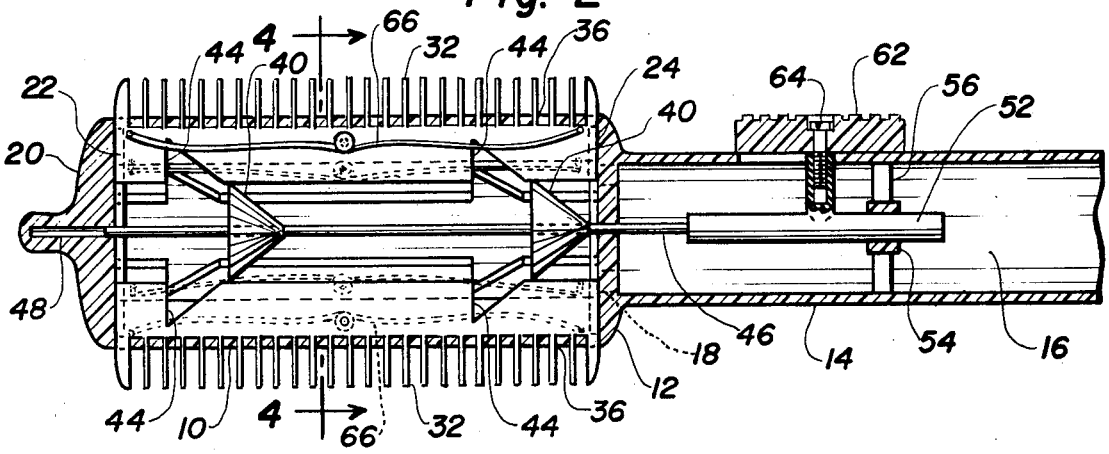
FIG. 2 is a fragmentary, longitudinal sectional view of the comb shown in FIG. 1 on a larger scale than employed in said figure, and illustrating details of the comb elements and the cam actuating means associated therewith, the teeth of the comb being illustrated in projecting position in said figure.

The combs 28 are moved to the projecting position thereof shown in FIG. 2 by cam means which, in the preferred embodiment of the invention, are conical cam members 40, which are complementary in shape to the edges 42 of notches 44 which, as shown in FIG. 6 in particular, are spaced slightly inward from the opposite ends of the combs 28 and are substantially shorter than said combs to minimize longitudinal movement thereof. As readily can be visualized from FIGS. 2 and 3, when the cams 40 are moved to the right as viewed in FIGS. 2 and 3 from the comb-retracted position shown in FIG. 3 to the comb-projected position shown in FIG. 2, the combs 28 will be moved radially outward to extend the teeth 32 through the openings 36 in the housing 10 and thereby render the comb operable for combing and/or curling purposes. The cams 40 are secured to an axially extending rod 46 which is slidable at one end within the guide hole 48 in the outer end member 20 and the opposite end of the rod 46 extends through another guide hole 50 in end 12 for the housing 10. The latter end of the rod 46 terminates in an enlarged section 52, which is coaxial therewith and the outer end thereof is slidable within a bearing 54, supported by a spider 56, thereby providing air passage means through the handle 14.

For purposes of actuating the cams 40, section 52 of the rod 46 has a lateral extension 58 thereon which extends through a slot 60 in handle 14 and the outer end thereof is connected to a manually engageable slide button 62 by any suitable means such as screw 64. The slide button 62 may appropriately be formed from plastics or any other suitable material and, likewise, the cams 40 may be formed from such similar material but it is preferred that the rod 46 and the enlarged section 52 thereof be formed from metal, but other material may be used, if desired.

When the cams 40 are moved from the retracted position shown in FIG. 3 to the extended or projected position shown in FIG. 2 for purposes of projecting the teeth 32 of the combs 28 through the openings 36 in the housing 10 by actuation of the slide button 62, the engagement of the perimeters of the larger ends of the cams 40 with the inner edges of the bars 30 of each of the combs 28 will maintain said combs and the teeth thereof in said projected positions until it is desired to retract the same. It will be seen from FIG. 2 of the drawings that when the combs 28 have been moved to the fully projected positions by cams 40, said peripheries of the larger ends of the cams will be slightly past the edges 42 of the cam notches 44 and engage the straight inner edges of the combs 28 and thereby lock the combs in such projected positions until retraction of the combs is desired. Retraction is effected by moving slide button 62 and, correspondingly, the cams 40 toward the left, as viewed in FIGS. 2 and 3, whereupon the combs may be retracted simultaneously, and this is accomplished by spring means.

Figure 7:
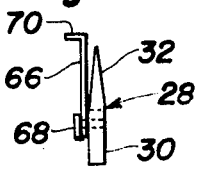
FIG. 7 is an end view of the comb and spring assembly shown in FIG. 6.

The aforementioned spring means comprise leaf-like spring members 66, which preferably are formed from spring wire and the same are arcuate in shape as shown in FIG. 6 in order to induce flexing of the spring members to effect such retraction of the combs. As shown in FIGS. 2, 3 and 6, the intermediate portion of the spring member 66 is connected to the elongated bars 30 of the combs 28, such, for example, as being looped around a headed anchor 68, and the opposite ends of the spring member 66 preferably are formed with a short lateral extension 70, as best shown in FIG. 7, in order that said extensions 70 may engage the interior of the cylindrical housing 10 as can be readily seen from FIG. 4. Accordingly, when the cams 40 have been moved to the retracting positioı shown in FIG. 3, the springs 66 may function simultaneously on all combs to retract the teeth 32 thereof through the openings 36, and thereby dispose the teeth in such position that the exterior of the housing 10 is smooth in order that the comb comprising the invention may be withdrawn, for example, from a curl which has been formed around the housing 10 when the teeth 32 are projected.

From the foregoing, it will be seen that the present invention provides a hair dressing comb unit having a plurality of individual comb members, preferably in excess of four, by which hair may be wound around the comb while the teeth are projected and, upon the completion of a curling or other similar operation, the teeth may be retracted simultaneously by manipulation of the manual slide button 62, whereby the smooth exterior surface of the housing 10 may be withdrawn from the formed curl.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. A hair dressing comb comprising in combination, a substantially cylindrical housing, a handle extending axially from one end thereof, a plurality of elongated combs mounted within said housing and extending longitudinally therein, means within said housing supporting said combs radially relative to the axis of said housing in circumferentially spaced positions relative to each other, said housing having openings therein through which at least the teeth of said combs can project radially outward from a retracted position substantially within said housing to extended operative positions therebeyond, cam means within said housing engageable simultaneously with said combs and movable in one direction to project at least the teeth of said combs simultaneously from said housing through said openings therein to the extended operative positions thereof, and spring means respectively mounted upon said combs and tensioned to normally hold said combs retracted within said housing and said cam means frictionally and slidably engaging said combs for axial movement in one direction to move said combs to extended operative position beyond said housing and thereby tension said springs to an even greater extent and said cams being slidably movable in an opposite direction to instantly release said tension of said springs to cause them to retract said combs to inoperative position within said housing.

2. The comb according to claim 1 in which said cam means comprise a plurality of cam members spaced longitudinally within said housing and coacting with complementary means on said combs adjacent opposite ends thereof, an elongated member supported for longitudinal movement axially within said housing, means connecting said cam means respectively to said member in longitudinally spaced locations thereof for engagement simultaneously with said complementary means on said combs, and means on said handle connected to said longitudinal member and operable manually in opposite directions respectively to effect projection of said combs and retraction thereof by said spring means.

3. The comb means according to claim 2 in which said cam means comprise a pair of similar substantially conical cam members fixed to said elongated member and said complementary means on said combs comprise notches having surfaces complementary to and engageable by said cam members, and said cam members at the conclusion of projecting said combs are disposed slightly past said notches and engage the inner edges of said combs to retain said combs locked in said projected positions.

4. The comb according to claim 2 further characterized by said combs having cam-engageable surfaces spaced longitudinally similarly to the spacing of said cam members and also complementary to the surfaces of said cam members.

5. The comb means according to claim 1 in which said housing has end members provided with similar radial slots slidably receiving the opposite ends of said combs to guide the same for radial movement in opposite directions, and said spring means comprising elongated leaf-like spring members connected respectively to said combs and having portions engaging the interior of said housing, said spring members being flexed in a direction to move said combs radially inward when said cam means are moved in said opposite direction thereof to retract said combs and thereby energize said spring members for retracting said combs when said cam means have been moved in said opposite direction.

6. The comb according to claim 5 in which said spring members comprise spring wire, means connecting the intermediate portions of said spring members to the midportions of said combs, said housing being substantially tubular, and the opposite ends of said spring members engaging the inner walls of said tubular housing to effect said retraction of said combs due to said flexed nature of said spring members.

7. The comb according to claim 1 in which said cam means comprise a plurality of cams substantially shorter than said combs and spaced longitudinally for engagement simultaneously with portions of said combs adjacent the outer ends thereof, thereby to effect simultaneous projecting movement of said combs in parallelism with each other.

8. The comb according to claim 7 further including an elongated member extending axially of said housing and into said handle, a hand-operated member slidable on said handle and connected to said elongated member for movement thereof in opposite axial directions, said cams being fixed to said elongated member for movement thereof by said member, said cams also being relatively short and capable of moving said combs outwardly of said housing by relatively short longitudinal movement of said cams by said hand-operated member on said handle.

* * * * *